US011209234B2

(12) United States Patent
Smith et al.

(10) Patent No.: US 11,209,234 B2
(45) **Date of Patent: *Dec. 28, 2021**

(54) INTERCHANGEABLE CAM

(71) Applicant: Hunter's Manufacturing Company, Inc., Suffield, OH (US)

(72) Inventors: Gary Smith, East Canton, OH (US); Jacob Hout, Akron, OH (US); Dean Mook, Akron, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/856,165

(22) Filed: Apr. 23, 2020

(65) Prior Publication Data

US 2020/0248981 A1 Aug. 6, 2020

Related U.S. Application Data

(63) Continuation of application No. 16/239,821, filed on Jan. 4, 2019, now Pat. No. 10,634,447.

(60) Provisional application No. 62/613,980, filed on Jan. 5, 2018.

(51) Int. Cl.

| | |
|---|---|
| ***F41B 5/10*** | (2006.01) |
| ***F41B 5/12*** | (2006.01) |
| *F41G 1/38* | (2006.01) |

(52) U.S. Cl.

CPC ..... *F41B 5/123* (2013.01); *F41B 5/105* (2013.01); *F41G 1/38* (2013.01)

(58) Field of Classification Search

CPC .... F41B 5/10; F41B 5/105; F41B 5/12; F41B 5/123

See application file for complete search history.

(56) References Cited

U.S. PATENT DOCUMENTS

| | | | |
|---|---|---|---|
| 2,092,361 | A | 9/1937 | Shirn |
| 3,043,287 | A | 7/1962 | Nelson |
| 3,561,419 | A | 2/1971 | Cucuzza, Sr. |
| 3,670,711 | A | 6/1972 | Firestone |
| 3,739,765 | A | 6/1973 | Moore |
| 4,192,281 | A | 3/1980 | King |
| 4,246,883 | A | 1/1981 | Ash |
| 4,338,910 | A | 7/1982 | Darlington |
| 4,593,675 | A | 6/1986 | Waiser |
| 4,603,676 | A | 8/1986 | Luoma |
| 4,649,892 | A | 3/1987 | Bozek |
| 4,662,345 | A | 5/1987 | Stephens |
| 4,665,885 | A | 5/1987 | Glomski et al. |

(Continued)

OTHER PUBLICATIONS

A Guide to the Crossbow, by W.F. Paterson, published by the Society of Archer-Antiquaries, 1990.

(Continued)

*Primary Examiner* — John A Ricci

(74) *Attorney, Agent, or Firm* — Emerson Thomson Bennett, LLC

(57) ABSTRACT

A bow assembly may include bow limbs on opposite sides and a cam rotatably supported to each bow limb. In some embodiments, the cams on each limb may be identical. In other embodiments, each cam may have a stud on each side of the cam that may engage with the bowstring. In yet other embodiments, each cam may have a channel on each side of the cam that may engage with the bowstring.

20 Claims, 4 Drawing Sheets

(56) References Cited

U.S. PATENT DOCUMENTS

| | | | | |
|---|---|---|---|---|
| 4,719,897 | A | 1/1988 | Gaudreau | |
| 4,721,092 | A | 1/1988 | Waiser | |
| 4,942,861 | A | 7/1990 | Bozek | |
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A | 10/1997 | Hadley | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,441,555 | B1 | 10/2008 | Larson | |
| 7,624,725 | B1 | 12/2009 | Choma | |
| 7,784,453 | B1 | 8/2010 | Yehle | |
| 8,069,848 | B1 | 12/2011 | Larson | |
| 8,443,790 | B2 | 5/2013 | Pestrue | |
| 8,499,753 | B2 | 8/2013 | Bednar | |
| 8,833,349 | B2 | 9/2014 | Park | |
| 9,494,379 | B2 | 11/2016 | Yehle | |
| 10,634,447 | B2 * | 4/2020 | Smith | F41B 5/105 |
| 2006/0086346 | A1 | 4/2006 | Middleton | |
| 2010/0170488 | A1 | 1/2010 | Rasor et al. | |
| 2017/0370673 | A1 * | 12/2017 | Yehle | F41B 5/105 |

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

INTERCHANGEABLE CAM

CROSS-REFERENCE TO RELATED APPLICATIONS

This application is a continuation of U.S. patent application Ser. No. 16/239,821, filed Jan. 4, 2019 and entitled INTERCHANGEABLE CAM, which claims the benefit of U.S. Provisional Application No. 62/613,980, filed Jan. 5, 2018, entitled INTERCHANGEABLE CAM, both of which are fully incorporated by reference herein.

BACKGROUND

The present subject matter is directed to apparatuses and methods regarding crossbows. More specifically the present subject matter is directed to the cams of a crossbow.

Crossbows have been used for many years as a weapon for hunting and fishing, and for target shooting. Crossbows typically comprise a bowstring engaged through set of cams to a set of limbs and to a set of power cords. It is of interest to make the cams reliable, light, inexpensive, low maintenance, and safe.

It remains desirable to improve the cams.

SUMMARY

In some embodiments, a bow assembly may comprise: a first bow limb positioned on a first side of the bow assembly; a second bow limb positioned on a second side of the bow assembly opposite the first side of the bow assembly; first and second cams, each having: 1) a cam axis; 2) a plate that: (a) is normal to the cam axis; (b) has a first surface defining a first side of the cam; (c) has a second surface opposite the first surface defining a second side of the cam; and (d) has a perimeter surface extending between the first and second surfaces having a bowstring channel to define a path of varying radius about the cam axis; 3) a first power cord channel positioned on the first side of the cam; and 4) a second power cord channel positioned on the second side of the cam; a bowstring having first and second ends; and first and second power cords. The first cam may be supportable to the first bow limb and may be rotatable with respect to the first bow limb about the cam axis of the first cam. The second cam may be supportable to the second bow limb and may be rotatable with respect to the second bow limb about the cam axis of the second cam. The first end of the bowstring may be operatively engageable to the bowstring channel of the first cam. The second end of the bowstring may be operatively engageable to the bowstring channel of the second cam. The first power cord may be operatively engageable to at least one of: the first power cord channel of the first cam and the second power cord channel of the first cam. The second power cord may be operatively engageable to at least one of: the first power cord channel of the second cam and the second power cord channel of the second cam. The first and second cams may be identical.

In some embodiments, a bow assembly may comprise: a first bow limb positioned on a first side of the bow assembly; a second bow limb positioned on a second side of the bow assembly opposite the first side of the bow assembly; first and second cams, each having: 1) a cam axis; 2) a plate that: (a) is normal to the cam axis; (b) has a first surface defining a first side of the cam; (c) has a second surface opposite the first surface defining a second side of the cam; and (d) has a perimeter surface extending between the first and second surfaces having a bowstring channel to define a path of varying radius about the cam axis; 3) a first stud positioned on the first side of the cam; and 4) a second stud positioned on the second side of the cam; and a bowstring having first and second ends. The first cam may be supportable to the first bow limb and may be rotatable with respect to the first bow limb about the cam axis of the first cam. The second cam may be supportable to the second bow limb and may be rotatable with respect to the second bow limb about the cam axis of the second cam. The first end of the bowstring may be operatively engageable to the bowstring channel of the first cam and to either one of the first stud of the first cam or the second stud of the first cam. The second end of the bowstring may be operatively engageable to the bowstring channel of the second cam and to either one of the first stud of the second cam or the second stud of the second cam.

In some embodiments, a bow assembly may comprise: a first bow limb positioned on a first side of the bow assembly; a second bow limb positioned on a second side of the bow assembly opposite the first side of the bow assembly; first and second cams, each having: 1) a cam axis; 2) a plate that: (a) is normal to the cam axis; (b) has a first surface defining a first side of the cam; (c) has a second surface opposite the first surface defining a second side of the cam; and (d) has a perimeter surface extending between the first and second surfaces having a bowstring channel to define a path of varying radius about the cam axis; 3) a first channel positioned in the plate that is open to the first surface of the cam and to the bowstring channel of the cam; and 4) a second channel positioned in the plate that is open to the second surface of the cam and to the bowstring channel of the cam; and a bowstring having first and second ends. The first cam may be supportable to the first bow limb and may be rotatable with respect to the first bow limb about the cam axis of the first cam. The second cam may be supportable to the second bow limb and may be rotatable with respect to the second bow limb about the cam axis of the second cam. The first end of the bowstring may be operatively engageable to the bowstring channel of the first cam and to either one of the first or the second channels in the first cam. The second end of the bowstring may be operatively engageable to the bowstring channel of the second cam and to either one of the first or the second channels in the second cam.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DEFINITIONS

Figure 1:
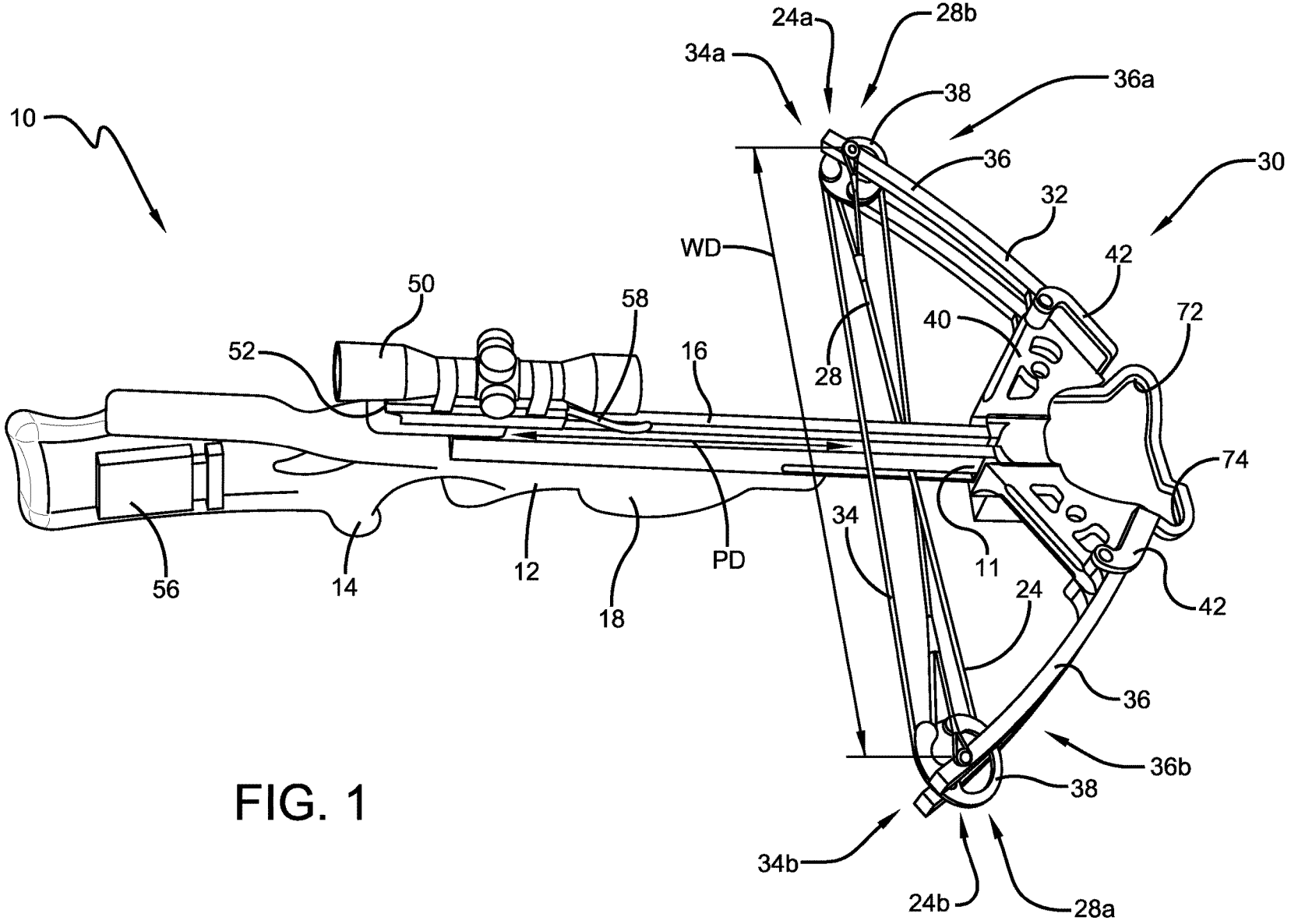
FIG. 1 is a view of one non-limiting embodiment of a crossbow.

The following definitions are controlling for the disclosed subject matter:

"Arrow" means a projectile that is shot with (or launched by) a bow assembly.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the 5 bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Power Stroke" means the linear distance that the bowstring is moved between the uncocked condition and the cocked condition.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

Referring now to the drawings wherein the showings are for purposes of illustrating embodiments of the present subject matter only and not for purposes of limiting the same, and wherein like reference numerals are understood to refer to like components, provided are a crossbow cam, crossbow cam components, a crossbow, and a method of using a crossbow, a crossbow cam, and crossbow cam components.

Figure 2:
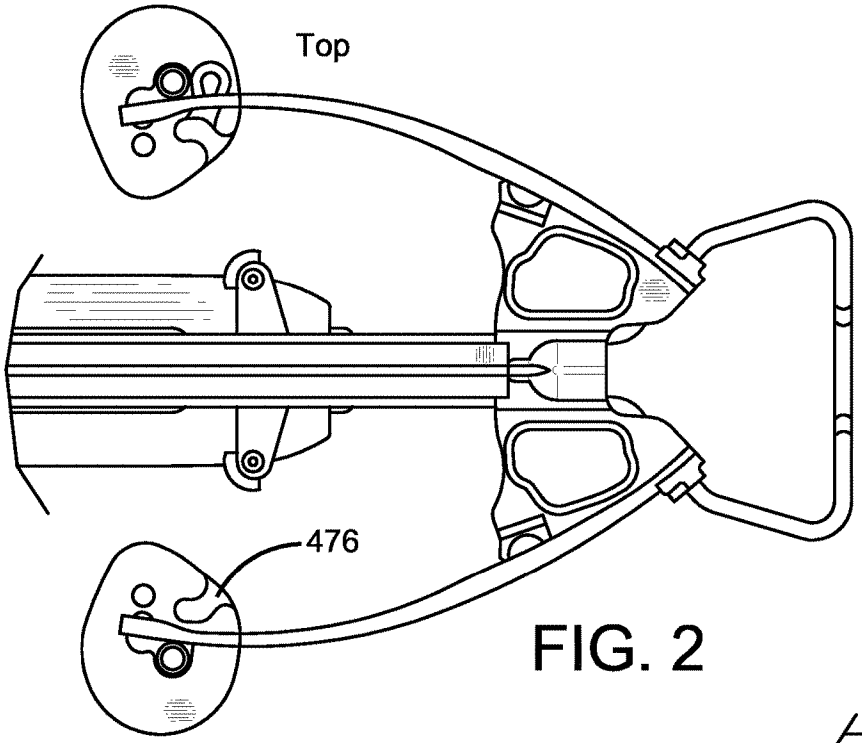
FIG. 2 is a close up top view of a second non-limiting embodiment of a crossbow.
Figure 3:
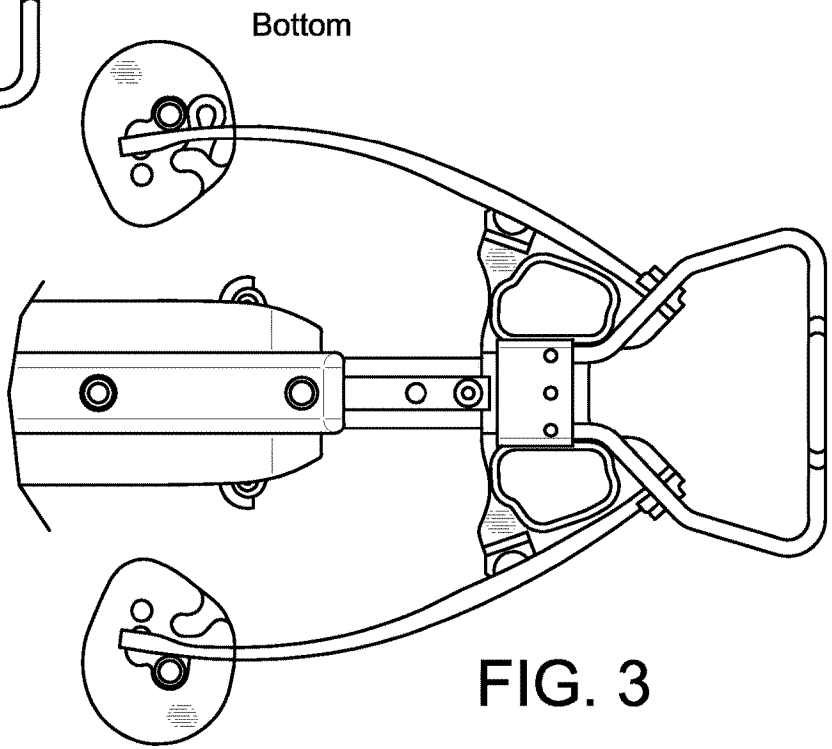
FIG. 3 is a close up bottom view of the second non-limiting embodiment of a crossbow.
Figure 4C:
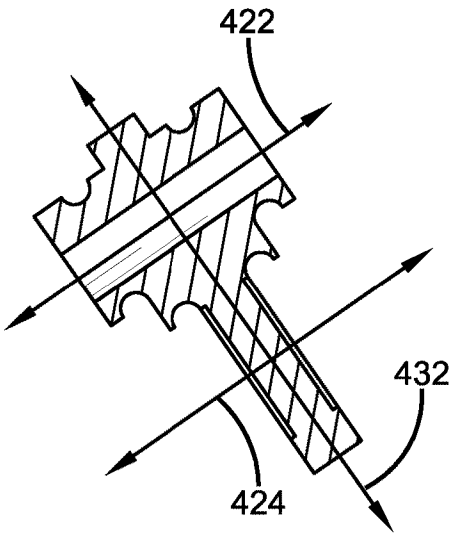
FIG. 4C shows a section view of the first non-limiting embodiment of a cam.
Figure 4B:
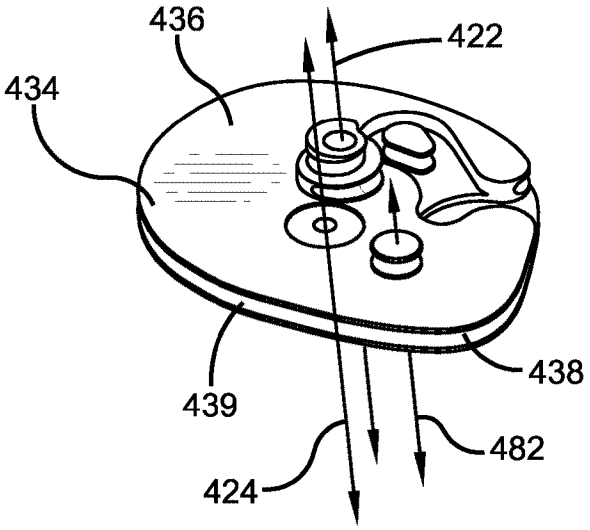
FIG. 4B shows a perspective view of the first non-limiting embodiment of a cam.
Figure 4E:
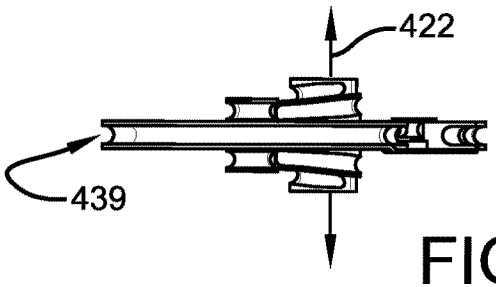
FIG. 4E shows a side view of the first non-limiting embodiment of a cam.
Figure 4A:
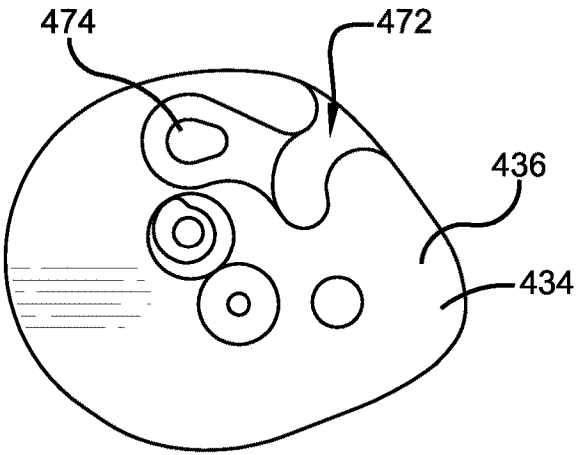
FIG. 4A shows a first non-limiting embodiment of a cam.
Figure 4D:
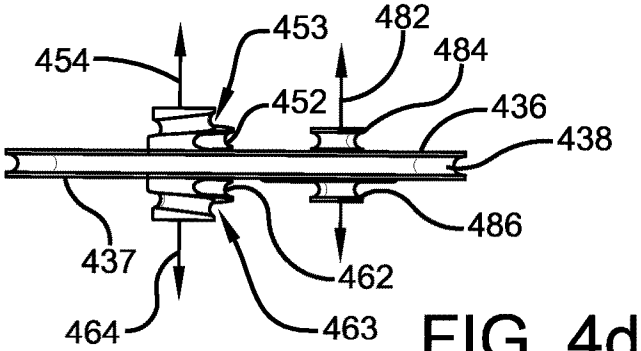
FIG. 4D shows a side view of the first non-limiting embodiment of a cam.

FIG. 1 shows a crossbow 10 according to one embodiment of the present subject matter. While the crossbow 10 shown uses a compound bow, it should be understood that this invention will work well with any type of crossbow chosen with sound judgment by a person of ordinary skill in the art. The crossbow 10 has a main beam 12 which may include a stock member 14, and a barrel 16. The main beam 12 may be made by assembling the stock member 14 and the barrel 16 together as separate components or, in another embodiment, the main beam 12 may be made as one piece. A handgrip 18 may be mounted to the main beam 12 in any conventional manner chosen with sound judgment by a person of ordinary skill in the art. A trigger mechanism 20 suitable for shooting an arrow is mounted to the main beam 12 in any suitable manner. It should be noted that the crossbow 10 may comprise any trigger mechanism chosen with sound judgment by a person of ordinary skill in the art. The crossbow 10 also includes a bow assembly 30 adapted to propel an associated arrow and having a bow 32 and a bowstring 34. The bow 32 may include a set of limbs 36, 36 that receive the bowstring 34 in any conventional manner chosen with sound judgment by a person of ordinary skill in the art. For the embodiment shown, a pair of wheels, pulleys, or cams 38, 38 mounted to the limbs 36, 36 receive the bowstring 34 in a known manner. In each of the non-limiting embodiments of FIGS. 1-3, the set of limbs has a first side 36*a* and a second side 36*b* opposite the first side 36*a* with first side 36*a* being operationally engaged with a first cam 38 and second side 36*b* being operationally engaged with a second cam 38. The bow may also include a riser 40. The riser 40 may comprise a set of limb pockets 42, 42 adapted to receive the limbs 36, 36, as shown in FIG. 1.

Without limitations, other crossbow components may be optionally used with a crossbow as provided herein. Without limitation, in some non-limiting embodiments, a crossbow 10 shown may include a scope 50 attached to a scope mount 52 that is supported on the main beam 12. Other optional components shown include a cocking unit 56, and arrow holder 58. In certain non-limiting embodiments, the riser 40 may have an opening 72 formed therein defining a foot stirrup 74 adapted for holding and balancing the crossbow by foot.

A crossbow 10 may have a power stroke distance PD. The distance between the pivot axes of the wheels, pulleys, or cams 38, 38 may be some distance WD.

With reference now to FIGS. 2-5, in certain embodiments cam 38 may have a first cam axis 422, a plate 434 normal to the first cam axis 422.

The plate 434 may have a first surface 436, a second surface 437 opposite the first surface 436, and a perimeter surface 438 extending between the first surface 436 and the second surface 437, where the perimeter surface 438 may be defined by a bowstring channel 439 extending around the first cam axis 422 to define a path of varying radius about the first cam axis 422. In certain embodiments, the cam 38 is rotatably engaged with a limb 36 such that the cam rotates about the first cam axis 422 during operation. The bowstring channel 439 may be adapted to operative engage with a bowstring 34 to pay onto or pay out from the bowstring channel 439 a bowstring 34 as the cam 38 rotates during operation. During a cocking operation, a bowstring 34 may do work on the cam 38 to cause the cam 38 to rotate as the bowstring 34 is moved into a cocked position and simultaneously pays out from the cam 38. By contrast during an uncocking operation, such as a firing operation, the cam 38 may do work on the bowstring 34 and pull the bowstring forward as the bowstring 34 is moved into an uncocked position and simultaneously pays onto the cam 38. In some non-limiting embodiments, the plate 434 may comprise a first channel 472 therein. The first channel 472 may be open to the first surface 436 and to the bowstring channel 439. The first channel 472 may be adapted to accept a first end of a bowstring 34 and to engage the first end of the bowstring 34 to the cam 38. The first channel 472 may have therein a first cleat 474 or first stud therein about which the first end of the bowstring 34 may be looped or otherwise fastened. In some non-limiting embodiments, the plate 434 may comprise a second channel 476 therein. The second channel 476 may be open to the second surface 437 and to the bowstring channel 439. The second channel 476 may be adapted to accept a first end of a bowstring 34 and to engage the first end of the bowstring 34 to the cam 38. The second channel 472 may have therein a second cleat or second stud therein about which the first end of the bowstring 34 may be looped or otherwise fastened.

The first cam axis 422 may be coincident with the axis of a first pin or first hole 426 extending along the first cam axis 422. In some non-limiting embodiments, a first hole 426 extending along the first cam axis 422 may be blind hole or a through hole.

In the certain embodiments, the cam 38 may further comprise a second cam axis 424 parallel to and offset from the first cam axis 422. In some embodiments, the second cam axis 424 may be adapted to facilitate coaxial engagement therewith of a mechanical pin, bolt 442 or other fastener about which one or more pulley 444 or other cable or string engagement hardware. A power cord 24 may be fastened to or looped over the pulley 444.

The second cam axis 424 may be coincident with the axis of a second pin or second hole 428 extending along the second cam axis 424. In some non-limiting embodiments, a second hole 428 extending along the second cam axis 424 may be blind hole or a through hole.

In certain embodiments, the cam 38 may comprise a first power cord channel 452. The first power cord channel 452 may extend from the first surface 436 along a first helical path 453 having a first helix axis 454 coincident with the first cam axis 422. The first helical path 453 may be a cylindrical helix or may be a spiral helix.

In certain embodiments, the cam 38 may comprise a second power cord channel 462. The second power cord channel 462 may extend from the second surface 437 along a second helical path 463 having a second helix axis 464 coincident with the first cam axis 422. The second helical path 463 may be a cylindrical helix or may be a spiral helix.

In a cylindrical helix the path changes position along the axis with the angle about the axis, but the distance of the path from the axis is constant. The following parametric equation in Cartesian coordinates, x, y, z, defines a non-limiting embodiment of a cylindrical helix: $x(t)=(r)\cos(t)$; $y(t)=(r)\sin(t)$; $z(t)=t$. Note that in the cylindrical helix equation above, as the parameter t increases, the point $(x(t), y(t), z(t))$ traces a right-handed helix of radius r about the z-axis, in a right-handed coordinate system.

Figure 5:
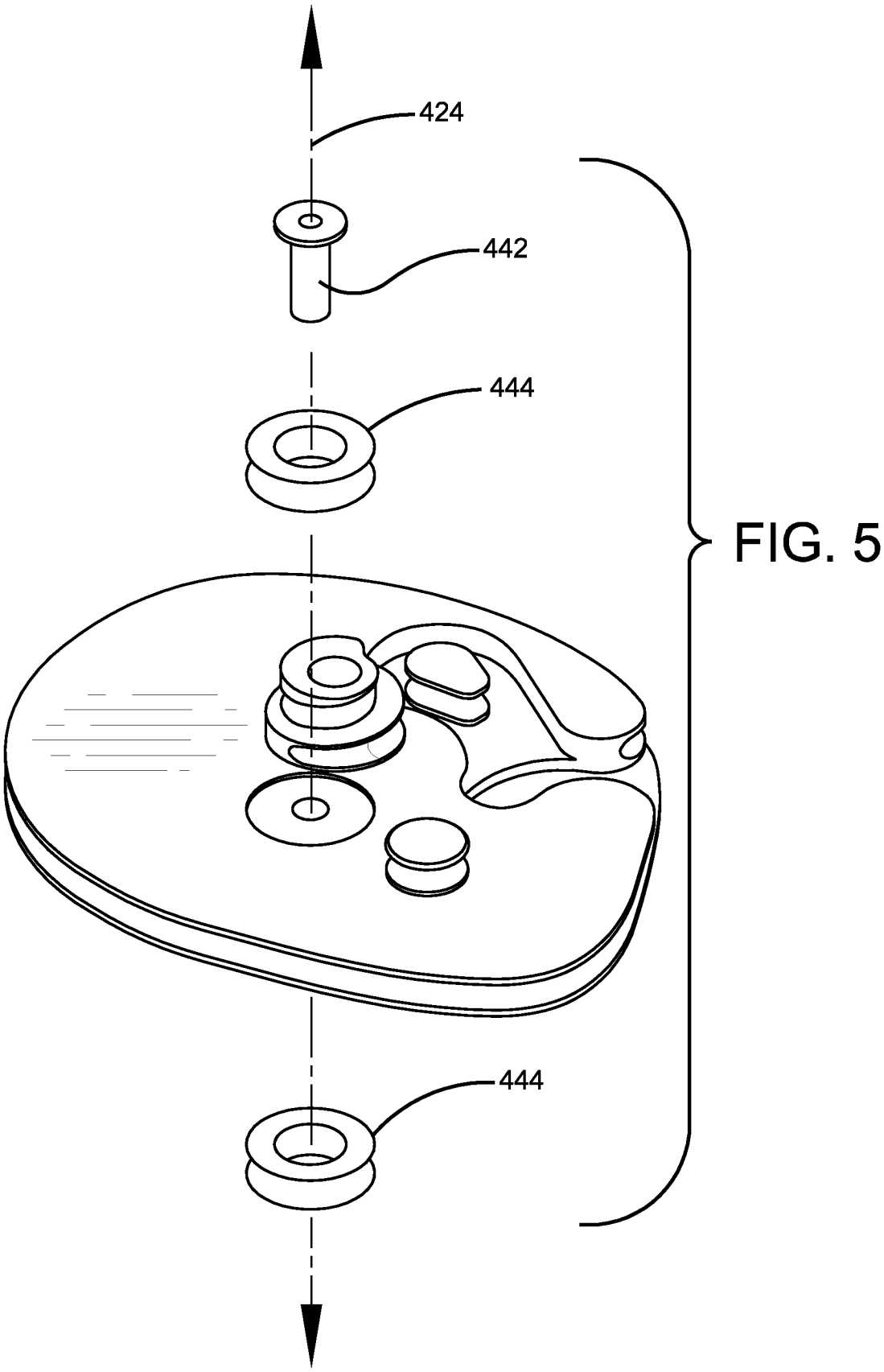
FIG. 5 is an exploded view of a first non-limiting embodiment of a cam assembly.

In a spiral helix the path changes position along the axis with the angle about the axis, and the distance of the path from the axis is also changes with the angle about the axis. The following parametric equation in Cartesian coordinates, x, y, z, defines a non-limiting embodiment of a spiral helix: $x(t)=(r)(t)\cos(t)$; $y(t)=(r)(t)\sin(t)$; $z(t)=t$. Note that in the spiral helix equation above, as the parameter t increases, the point $(x(t), y(t), z(t))$ traces a right-handed helix of variable radius about the z-axis, in a right-handed coordinate system. While the non-limiting embodiment shown in FIGS. 4-5 show the first helical path 453 is a spiral helix where the distance of the path 453 from the first helix axis 454 decreases with distance from the first plane 432, this is not limiting; it is also contemplated that the present subject matter includes a first helical path that is a spiral helix where the distance of the path from the helix axis increases with distance from the first plane. Similarly it is contemplated that the present subject matter includes a second helical path that is a spiral helix where the distance of the path from the helix axis increases with distance from the second plane.

The cam 38 may further comprise a projection axis 482 parallel to and offset from the first cam axis 422, and parallel to and offset from the second cam axis 424. The cam 38 may comprise a first projection 484 extending from the first surface 436 along the projection axis 482. The cam 38 may comprise a second projection 486 extending from the second surface along the projection axis. The first projection, or the second projection or both projections may be adapted to facilitate engagement therewith of a power cord 24, 28. A power cord may be fastened to or looped over a projection.

In certain non-limiting embodiments, the cam 38 may be formed such that it is symmetric about the first plane 432. In certain non-limiting embodiments, the cam 38 may be achiral, such that it is identical to its own mirror image.

A bow assembly 30 may be formed having a bow 32, a set of cams 38, a bowstring 34, and a plurality of power cords 24. A bow 32 may have a set of limbs 36 with the set of cams 38 mounted to the limbs 36. The set of cams 38 may have a first cam 38, and a second cam 38 identical to the first cam 38. Each cam 38 may have a first cam axis 422, and a plate 434 normal to the first cam axis 422 . . . . The plate 434 defines a first plane 432 therethrough. The plate 434 may have a first surface 436, a second surface 437 opposite the first surface 436, and a perimeter surface 438 extending between the first surface 436 and the second surface 437, the perimeter surface 438 defined by a bowstring channel 439 extending around the first axis 422 to define a path of varying radius about the first axis 422. The bowstring channel may be concave in order to be adapted to accept a bowstring 34, or may comprise edges or walls or other structures adapted to retain a bowstring 34. Each cam may further have a second cam axis 424 parallel to and offset from the first cam axis 422. Each cam 38 may have a first power cord channel 452 extending from the first surface 436 along a first helical path 453 having a first helix axis 454 coincident with the first cam axis 422, and a second power cord channel 462 extending from the second surface 437 along a second helical path 463 having a second helix axis 464 coincident with first cam axis 422. A bowstring 34 may have a first end **34*a* of the bowstring 34 and a second end 34*b* of the bowstring 34 opposite the first end 34*a* of the bowstring 34, wherein the first end 34*a* of the bowstring 34 is operatively engaged with the first cam 38, and wherein the second end 34*b* of the bowstring 34 is operatively engaged with the second cam 38. A first power cord 24 having a first end 24*a* of the first power cord 24 and a second end 24*b* of the first power cord 24 opposite the first end 24*a* of the first power cord 24, wherein the first end 24*a* of the first power cord 24 is engaged with the first power cord channel 452 of the first cam 38; and a second power cord 28 having a first end 28*a* of the second power cord 28 and a second end 28*b* of the second power cord 28 opposite the first end 28*a* of the second power cord 28, wherein the first end 28*a* of the second power cord 28 is engaged with the first power cord channel 452 of the second cam 38**.

In some non-limiting embodiments, the bow assembly 30 may further comprise a first channel 472 in the plate 434 open to the first surface 436 and to the bowstring channel 439; and a second channel 476 in the plate open to the second surface 437 and to the bowstring channel 439.

In some non-limiting embodiments, the bow assembly 30 may further comprise a first through hole 426 extending along the first cam axis 422.

In some non-limiting embodiments, the bow assembly 30 may further comprise a second through hole 428 extending along the second cam axis 424.

In some non-limiting embodiments, the bow assembly 30 may further comprise a projection axis 482 parallel to and offset from the first cam axis 422, and parallel to and offset from the second cam axis 424; a first projection 484 extending from the first surface 436 along the projection axis 482;

and a second projection 486 extending from the second surface 486 along the projection axis.

In some non-limiting embodiments of the bow assembly 30, the first helical path 453 is a spiral helix.

In some non-limiting embodiments of the bow assembly 30 the second end 24*b* of the first power cord 24 is engaged with the second power cord channel 462 of the first cam 38.

A method of creating a bow assembly 30 may comprise providing a bow 32 having a set of limbs 36; providing a set of cams 38; providing a bowstring 34; providing a first power cord 24; providing a second power cord 28; operationally engaging the first cam 38 to a first side 36*a* of the set of limbs 36; operationally engaging the second cam 38 to the second side 36*b* of the first set of limbs 36; operationally engaging the first end 34*a* of the bowstring 34 with the first cam 38; operationally engaging the second end 34*b* of the bowstring 34 with the second cam 38; operationally engaging the first end 24*a* of the first power cord 24 with the first power cord channel 452 of the first cam 38; and operationally engaging the first end 28*a* of the second power cord 28 with the first power cord channel 452 of the second cam 38. The set of limbs 36 may have a first side 36*a* of the set of limbs 36, and a second side 36*b* of the set of limbs 36 opposite the first side 36*a* of the set of limbs 36. The set of cams 38 may have a first cam 38, and a second cam 38 identical to the first cam 38. Each of the first cam 38 and the second cam 38 may have a first cam axis 422, a plate 434 normal to the first cam axis 422, and defining a first plane 432 therethrough, the plate 434 having a first surface 436, a second surface 437 opposite the first surface 436, and a perimeter surface 438 extending between the first surface 436 and the second surface 437, the perimeter surface 438 may be defined by a bowstring channel 439 extending around the first cam axis 422 to define a path of varying radius about the first cam axis 422, a second cam axis 424 parallel to and offset from the first cam axis 422, a first power cord channel 452 extending from the first surface 436 along a first helical path 453 having a first helix axis 454 coincident with the second cam axis 424, and a second power cord channel 462 extending from the second surface 437 along a second helical path 463 having a second helix axis 464 coincident with second cam axis 424. The bowstring 34 may have a first end 34*a* of the bowstring 34, and a second end 34*b* of the bowstring 34 opposite the first end 34*a* of the bowstring 34. A first power cord 24 may have a first end 24*a* of the first power cord 24, and a second end 24*b* of the first power cord 24 opposite the first end 24*a* of the first power cord 24. A second power cord 28 may have a first end 28*a* of the second power cord 28, and a second end 28*b* of the second power cord 28 opposite the first end 28*a* of the second power cord 28.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

Having thus described the invention, it is now claimed:

1. A bow assembly comprising:

a first bow limb positioned on a first side of the bow assembly;

a second bow limb positioned on a second side of the bow assembly opposite the first side of the bow assembly;

first and second cams, each having: 1) a cam axis; 2) a plate that: (a) is normal to the cam axis; (b) has a first surface defining a first side of the cam; (c) has a second surface opposite the first surface defining a second side of the cam; and (d) has a perimeter surface extending between the first and second surfaces having a bowstring channel to define a path of varying radius about the cam axis; 3) a first power cord channel positioned on the first side of the cam; and 4) a second power cord channel positioned on the second side of the cam;

a bowstring having first and second ends; and first and second power cords;

wherein:

1) the first cam is supportable to the first bow limb and is rotatable with respect to the first bow limb about the cam axis of the first cam;

2) the second cam is supportable to the second bow limb and is rotatable with respect to the second bow limb about the cam axis of the second cam;

3) the first end of the bowstring is operatively engageable to the bowstring channel of the first cam;

4) the second end of the bowstring is operatively engageable to the bowstring channel of the second cam;

5) the first power cord is operatively engageable to at least one of: the first power cord channel of the first cam and the second power cord channel of the first cam;

6) the second power cord is operatively engageable to at least one of: the first power cord channel of the second cam and the second power cord channel of the second cam;

7) the first and second cams are identical;

8) the plate of the first cam defines a first plane;

9) the plate of the second cam defines a second plane;

10) the first cam is symmetric about the first plane; and 11) the second cam is symmetric about the second plane.

2. The bow assembly of claim 1 wherein:

the bow assembly is supported to a main beam defining a crossbow.

3. The bow assembly of claim 1 wherein:

the first cam includes a first stud positioned on the first side of the first cam and a second stud positioned on the second side of the first cam;

the second cam includes a first stud positioned on the first side of the second cam and a second stud positioned on the second side of the second cam;

the first end of the bowstring is operatively engageable to either one of the first stud of the first cam or the second stud of the first cam; and the second end of the bowstring is operatively engageable to either one of the first stud of the second cam or the second stud of the second cam.

4. The bow assembly of claim 1 wherein:

the first cam includes a first channel in the plate that is open to the first surface of the first cam and to the bowstring channel of the first cam;

the first cam includes a second channel in the plate that is open to the second surface of the first cam and to the bowstring channel of the first cam;

the second cam includes a first channel in the plate that is open to the first surface of the second cam and to the bowstring channel of the second cam;

the second cam includes a second channel in the plate that is open to the second surface of the second cam and to the bowstring channel of the second cam;

the first end of the bowstring is operatively engageable to either one of the first or the second channels in the first cam; and the second end of the bowstring is operatively engageable to either one of the first or the second channels in the second cam.

5. The bow assembly of claim 1 wherein:

a first through hole extends along the cam axis of the first cam; and a second through hole extends along the cam axis of the second cam.

6. A bow assembly comprising:

a first bow limb positioned on a first side of the bow assembly;

a second bow limb positioned on a second side of the bow assembly opposite the first side of the bow assembly;

first and second cams, each having: 1) a cam axis; 2) a plate that: (a) is normal to the cam axis; (b) has a first surface defining a first side of the cam; (c) has a second surface opposite the first surface defining a second side of the cam; and (d) has a perimeter surface extending between the first and second surfaces having a bowstring channel to define a path of varying radius about the cam axis; 3) a first power cord channel positioned on the first side of the cam; and 4) a second power cord channel positioned on the second side of the cam;

a bowstring having first and second ends; and first and second power cords;

wherein:

1) the first cam is supportable to the first bow limb and is rotatable with respect to the first bow limb about the cam axis of the first cam;

2) the second cam is supportable to the second bow limb and is rotatable with respect to the second bow limb about the cam axis of the second cam;

3) the first end of the bowstring is operatively engageable to the bowstring channel of the first cam;

4) the second end of the bowstring is operatively engageable to the bowstring channel of the second cam;

5) the first power cord is operatively engageable to at least one of: the first power cord channel of the first cam and the second power cord channel of the first cam;

6) the second power cord is operatively engageable to at least one of: the first power cord channel of the second cam and the second power cord channel of the second cam;

7) the first and second cams are identical;

8) the first power cord channel of the first cam includes a helical path;

9) the second power cord channel of the first cam includes a helical path;

10) the first power cord channel of the second cam includes a helical path; and 11) the second power cord channel of the second cam includes a helical path.

7. The bow assembly of claim 6 wherein:

the bow assembly is supported to a main beam defining a crossbow.

8. The bow assembly of claim 6 wherein:

the first cam includes a first stud positioned on the first side of the first cam and a second stud positioned on the second side of the first cam;

the second cam includes a first stud positioned on the first side of the second cam and a second stud positioned on the second side of the second cam;

the first end of the bowstring is operatively engageable to either one of the first stud of the first cam or the second stud of the first cam; and the second end of the bowstring is operatively engageable to either one of the first stud of the second cam or the second stud of the second cam.

9. The bow assembly of claim 6 wherein:

the first cam includes a first channel in the plate that is open to the first surface of the first cam and to the bowstring channel of the first cam;

the first cam includes a second channel in the plate that is open to the second surface of the first cam and to the bowstring channel of the first cam;

the second cam includes a first channel in the plate that is open to the first surface of the second cam and to the bowstring channel of the second cam;

the second cam includes a second channel in the plate that is open to the second surface of the second cam and to the bowstring channel of the second cam;

the first end of the bowstring is operatively engageable to either one of the first or the second channels in the first cam; and the second end of the bowstring is operatively engageable to either one of the first or the second channels in the second cam.

10. A bow assembly comprising:

a first bow limb positioned on a first side of the bow assembly;

a second bow limb positioned on a second side of the bow assembly opposite the first side of the bow assembly;

first and second cams, each having: 1) a cam axis; 2) a plate that: (a) is normal to the cam axis; (b) has a first surface defining a first side of the cam; (c) has a second surface opposite the first surface defining a second side of the cam; and (d) has a perimeter surface extending between the first and second surfaces having a bowstring channel to define a path of varying radius about the cam axis; 3) a first stud positioned on the first side of the cam; and 4) a second stud positioned on the second side of the cam; and a bowstring having first and second ends;

wherein:

1) the first cam is supportable to the first bow limb and is rotatable with respect to the first bow limb about the cam axis of the first cam;

2) the second cam is supportable to the second bow limb and is rotatable with respect to the second bow limb about the cam axis of the second cam;

3) the first end of the bowstring is operatively engageable to the bowstring channel of the first cam and to either one of the first stud of the first cam or the second stud of the first cam; and 4) the second end of the bowstring is operatively engageable to the bowstring channel of the second cam and to either one of the first stud of the second cam or the second stud of the second cam.

11. The bow assembly of claim 10 wherein:

the bow assembly is supported to a main beam defining a crossbow.

12. The bow assembly of claim 10 wherein:

the plate of the first cam defines a first plane;

the plate of the second cam defines a second plane;

the first cam is symmetric about the first plane; and the second cam is symmetric about the second plane.

13. The bow assembly of claim 10 wherein:

the first cam has a first power cord channel positioned on the first side of the first cam and a second power cord channel positioned on the second side of the first cam;

the second cam has a first power cord channel positioned on the first side of the second cam and a second power cord channel positioned on the second side of the second cam;

a first power cord is operatively engageable to at least one of: the first power cord channel of the first cam and the second power cord channel of the first cam; and a second power cord is operatively engageable to at least one of: the first power cord channel of the second cam and the second power cord channel of the second cam.

14. The bow assembly of claim 10 wherein:

a first through hole extends along the cam axis of the first cam; and a second through hole extends along the cam axis of the second cam.

15. A bow assembly comprising:

a first bow limb positioned on a first side of the bow assembly;

a second bow limb positioned on a second side of the bow assembly opposite the first side of the bow assembly;

first and second cams, each having: 1) a cam axis; 2) a plate that: (a) is normal to the cam axis; (b) has a first surface defining a first side of the cam; (c) has a second surface opposite the first surface defining a second side of the cam; and (d) has a perimeter surface extending between the first and second surfaces having a bowstring channel to define a path of varying radius about the cam axis; 3) a first channel positioned in the plate that is open to the first surface of the cam and to the bowstring channel of the cam; and 4) a second channel positioned in the plate that is open to the second surface of the cam and to the bowstring channel of the cam; and a bowstring having first and second ends;

wherein:

1) the first cam is supportable to the first bow limb and is rotatable with respect to the first bow limb about the cam axis of the first cam;

2) the second cam is supportable to the second bow limb and is rotatable with respect to the second bow limb about the cam axis of the second cam;

3) the first end of the bowstring is operatively engageable to the bowstring channel of the first cam and to either one of the first or the second channels in the first cam; and 4) the second end of the bowstring is operatively engageable to the bowstring channel of the second cam and to either one of the first or the second channels in the second cam.

16. The bow assembly of claim 15 wherein:

the bow assembly is supported to a main beam defining a crossbow.

17. The bow assembly of claim 15 wherein:

the plate of the first cam defines a first plane;

the plate of the second cam defines a second plane;

the first cam is symmetric about the first plane; and the second cam is symmetric about the second plane.

18. The bow assembly of claim 15 wherein:

the first cam has a first power cord channel positioned on the first side of the first cam and a second power cord channel positioned on the second side of the first cam;

the second cam has a first power cord channel positioned on the first side of the second cam and a second power cord channel positioned on the second side of the second cam;

a first power cord is operatively engageable to at least one of: the first power cord channel of the first cam and the second power cord channel of the first cam; and a second power cord is operatively engageable to at least one of: the first power cord channel of the second cam and the second power cord channel of the second cam.

19. The bow assembly of claim 15 wherein:

the first cam includes a first stud positioned within the first channel of the first cam and a second stud positioned within the second channel of the first cam;

the second cam includes a first stud positioned within the first channel of the second cam and a second stud positioned within the second channel of the second cam;

the first end of the bowstring is operatively engageable to either one of the first stud of the first cam or the second stud of the first cam; and the second end of the bowstring is operatively engageable to either one of the first stud of the second cam or the second stud of the second cam.

20. The bow assembly of claim 15 wherein:

a first through hole extends along the cam axis of the first cam; and a second through hole extends along the cam axis of the second cam.

* * * * *